US012630766B2

(12) United States Patent
Yang et al.

(10) Patent No.: US 12,630,766 B2
(45) Date of Patent: May 19, 2026

(54) LARGE COKE OVEN BODY 6S FLAT LAYER BUILDING METHOD

(71) Applicant: CHINA MCC5 GROUP CORP. LTD., Chengdu (CN)

(72) Inventors: Yi Yang, Chengdu (CN); Gang He, Chengdu (CN); Jinhong Xie, Chengdu (CN); Changjun Chen, Chengdu (CN); Mulin Li, Chengdu (CN); Mao Liang, Chengdu (CN); Shouquan Chen, Chengdu (CN); Yingjun Tang, Chengdu (CN); Xiaoliang Zhang, Chengdu (CN)

(73) Assignee: CHINA MCC5 GROUP CORP. LTD., Chengdu (CN)

( * ) Notice: Subject to any disclaimer, the term of this patent is extended or adjusted under 35 U.S.C. 154(b) by 194 days.

(21) Appl. No.: 18/567,492

(22) PCT Filed: Mar. 3, 2023

(86) PCT No.: PCT/CN2023/079452
§ 371 (c)(1),
(2) Date: Dec. 6, 2023

(87) PCT Pub. No.: WO2024/077844
PCT Pub. Date: Apr. 18, 2024

(65) Prior Publication Data

US 2025/0066669 A1 Feb. 27, 2025

(30) Foreign Application Priority Data

Oct. 13, 2022 (CN) ..... 202211251059.9

(51) Int. Cl.
*C10B 29/02* (2006.01)
*C10B 29/04* (2006.01)

(52) U.S. Cl.
CPC ..... *C10B 29/02* (2013.01); *C10B 29/04* (2013.01)

(58) Field of Classification Search
CPC ..... C10B 29/02; C10B 29/04
See application file for complete search history.

(56) References Cited

U.S. PATENT DOCUMENTS 4,364,798 A * 12/1982 Costa ..... C10B 29/06 264/30
10,253,980 B2 * 4/2019 Bowser, Jr. ..... F23M 5/02
(Continued)

FOREIGN PATENT DOCUMENTS

CN 101081986 A 12/2007
CN 102373063 A 3/2012
(Continued)

OTHER PUBLICATIONS

IP com Machine Translation of CN 102373063 Obtained Sep. 25, 2025. (Year: 2025).*
(Continued)

*Primary Examiner* — Jonathan Miller
(74) *Attorney, Agent, or Firm* — NKL Law; Allen Xue

(57) ABSTRACT

A method for building a coke own includes steps of building an oven body building three-dimensional control network, and building a coke side or machine side refractory brick receiving platform; based on the three-dimensional control network and the refractory brick receiving platform, marking out a laying position of each layer of refractory bricks layer by layer, arranging the refractory bricks required by laying of each layer by layer, laying the refractory bricks layer by layer according to the marking and the arrangement, jointing the laid refractory bricks layer by layer, cleaning the jointed refractory bricks layer by layer, and checking and accepting the cleaned refractory bricks layer by layer. In this
(Continued)

method, quality control is carried out on coke oven body masonry on the whole through six dimensions.

9 Claims, 6 Drawing Sheets

(56) References Cited

U.S. PATENT DOCUMENTS

| | | | | |
|---|---|---|---|---|
| 10,927,302 | B2 * | 2/2021 | Bowser, Jr. | F27D 1/0006 |
| 11,441,079 | B2 * | 9/2022 | Bowser, Jr | F27B 13/10 |
| 11,525,089 | B2 * | 12/2022 | Bowser, Jr. | F27D 1/063 |
| 2016/0281983 | A1 * | 9/2016 | Bowser, Jr. | F23M 5/02 |
| 2018/0362853 | A1 * | 12/2018 | Bowser, Jr. | C10B 5/04 |
| 2018/0362854 | A1 * | 12/2018 | Bowser, Jr. | C10B 29/02 |
| 2021/0102124 | A1 * | 4/2021 | Bowser, Jr | F27D 1/04 |
| 2021/0189246 | A1 * | 6/2021 | Bowser, Jr. | F27D 1/04 |

FOREIGN PATENT DOCUMENTS

| | | | |
|---|---|---|---|
| CN | 103468276 | A | 12/2013 |
| CN | 103666494 | A | 3/2014 |
| CN | 105778934 | A | 7/2016 |
| CN | 111808617 | A | 10/2020 |
| CN | 115558508 | A | 1/2023 |
| JP | 2015214618 | A | 12/2015 |
| JP | 2019218421 | A | 12/2019 |

OTHER PUBLICATIONS

IP com Machine Translation of CN 103666494 Obtained Sep. 25, 2025. (Year: 2025).*

IP com Machine Translation of CN 105778934 Obtained Sep. 25, 2025 (Year: 2025).*

* cited by examiner

LARGE COKE OVEN BODY 6S FLAT LAYER BUILDING METHOD

TECHNICAL FIELD

The present invention belongs to the large coke oven body masonry technique, and particularly relates to a large coke oven body 6S flat layer building method.

BACKGROUND

Coke ovens are the core equipment of coking engineering. Large coke ovens generally refer to top-charging coke ovens over 7 m and stamp-charging coke ovens over 5.5 m, with larger capacity, higher energy efficiency, and lower unit emissions. Building a large coke oven can reduce pollutant emissions, reduce production capital costs, improve production efficiency, reduce personnel, extend oven life, and improve product quality. However, the complex structure and cumbersome process of large coke oven bodies have brought new challenges to the masonry technology of large coke ovens.

The large coke oven body is mainly composed of an oven top, a carbonization chamber, a combustion chamber, an inclined flue, and a regenerator. Its structure is complex, and the masonry quality directly affects the production level of the coke oven after production. There are over ten refractory materials and over 1000 refractory bricks used in the construction of a single large coke oven body, with a total weight of about 30,000 tons. The masonry process is complex and the workload is enormous. The traditional masonry of the coke oven body adopts a staggered masonry process controlled by the oven head, which controls the masonry precision of the coke oven wall by first laying each oven head. The masonry quality and efficiency are extremely dependent on high-level oven builders; moreover, due to the fact that each wall in the oven body is individually controlled for masonry precision based on the first built oven head, it is difficult to effectively control the overall precision and quality of the oven body. Meanwhile, in the process of first laying the oven head, the refractory bricks are directly stacked on the newly built wall inside the oven, causing confusion in the management of refractory materials on the construction site, making the refractory materials and the newly built wall easily contaminated by masonry slurry, and making it difficult to ensure the cleanliness of the coke oven body.

SUMMARY

The purpose of the present invention lies in that: the present invention provides a large coke oven body 6S flat layer building method, solving the problems of high difficulty in traditional coke oven masonry and difficulty in effectively controlling quality.

The purpose of the present invention is realized through the following technical solutions:

A large coke oven body 6S flat layer building method, comprising the following steps:

step S1, checking and accepting the coke oven foundation platform;

step S2, building an oven body building three-dimensional control network, and building a coke side or machine side refractory brick receiving platform;

step S3, based on the three-dimensional control network, marking out a laying position of each layer of refractory bricks layer by layer;

step S4, based on the refractory brick receiving platform, arranging the refractory bricks required by laying of each layer by layer;

step S5, based on the three-dimensional control network, laying the refractory bricks layer by layer according to the marking and the arrangement;

step S6, jointing the laid refractory bricks layer by layer;

step S7, cleaning the jointed refractory bricks layer by layer; and step S8, based on the three-dimensional control network, checking and accepting the cleaned refractory bricks layer by layer.

Furthermore, the step S2 of building an oven body building three-dimensional control network comprises: step S2.1, setting out of a benchmark line for the coke oven foundation platform; step S2.2, installation and fixation of oven columns or vertical poles; step S2.3, installation of horizontal poles; step S2.4, laying of masonry control lines;

forming height control lines for each wall and each layer of refractory bricks of the entire oven body by a wall layer height line on the oven column, a wall center line and a wall width line on the horizontal pole; controlling each wall length in the oven by a longitudinal coke oven center line and longitudinal coke oven control sideline on both sides, forming a control line for the entire wall length.

Furthermore, the step S2.1 of setting out of a benchmark line for the coke oven foundation platform comprises: setting out longitudinal coke oven center lines, longitudinal coke oven control sidelines and oven end carbonization chamber center lines on the accepted coke oven foundation platform and buttress walls on both ends using survey control points of the coke oven foundation platform.

Furthermore, the step S2.2 of installation and fixation of oven columns (11) or vertical poles is as follows:

when the coke oven building process is to first erect oven columns and then build the oven body, first installing oven columns which will be installed on a small corbel of a roof edge beam of the coke oven foundation platform to build a three-dimensional control network, and measuring the elevation of the small corbel before installation to ensure its elevation within the set range;

placing each combustion chamber center line of the coke oven onto the corresponding small corbel through control points, and rechecking it based on the benchmark line set out on the coke oven foundation platform to ensure the accurate position of each combustion chamber center line;

hoisting the oven columns and erecting the oven columns, then adjusting the center so that the oven column center is identical with the combustion chamber center on the small corbel, and the horizontal deviation value is within the set range;

after adjusting the center, temporarily fixing the oven columns, and at the top position of the oven column, connecting and fixing the entire row of oven columns by horizontal fixing poles;

controlling the oven column spacing deviation and overall deviation of the oven columns within the set range;

slightly adjusting the elevation, verticality, and horizontal position of the oven column by adjusting the adjusting pad between the bottom of the oven column and the coke oven foundation platform, as well as the adjusting wedge between the side of the oven column and the coke oven foundation platform;

after rechecking the position and verticality of the oven column, setting out the center line of each combustion chamber on the small corbel on the oven column, and setting out the wall layer height line on the oven body masonry on the oven column; and when the coke oven building process is to first build the oven body and then erect oven columns, first temporarily installing vertical poles to build a three-dimensional control network, the height of the vertical pole being determined according to the height of the coke oven masonry; after adjusting the verticality and horizontal position of the vertical pole, setting out the center line of each combustion chamber on the small corbel on the vertical pole, and setting out the wall layer height line of the oven body masonry on the vertical pole, the lower part of the vertical pole being fixed to the small corbel by anchor bolts or embedded parts.

Furthermore, in the step S2.2, a lower cross brace is pulled oppositely between the lower end of the oven column and the coke oven foundation platform, and the lower cross brace is sleeved with an adjustment sleeve; the lower cross brace is connected with an adjusting bolt that presses the adjustment sleeve, and the adjustment sleeve temporarily compresses the oven column and the coke oven foundation platform.

Furthermore, the step S2.3 of installing horizontal poles is as follows: horizontally arranging the horizontal poles between two oven columns at sides of the coke oven, and temporarily fixing the horizontal poles and oven columns by temporary stationary fixtures; after relaxing the temporary stationary fixtures, the horizontal poles can move vertically along the oven columns, and the horizontal poles and the oven columns are fixed temporarily after the temporary stationary fixtures are tightened.

When laying each layer of refractory bricks, adjusting the horizontal poles to align at the elevation line on this layer of oven columns, and setting out a wall center line and a wall width line of the wall body to be built on the horizontal poles, in order to provide precision control for laying of this layer of refractory bricks.

Furthermore, the step S2.4 of laying of masonry control lines is as follows: drawing the wall center markings and wall width markings of the regenerator wall, inclined flue wall, carbonization chamber and combustion chamber wall or oven top wall in the oven body on the horizontal poles, and laying the wall center line and wall width line according to the markings during the masonry process, in order to dynamically control the masonry precision in real time.

Furthermore, the step S2 of building a coke side or machine side refractory brick receiving platform comprises: to realize fixed point layer-by-layer arrangement of refractory bricks, a refractory brick receiving platform is built at the machine side or coke side according to the receiving situation of the coke oven masonry refractory bricks; fixed feeding points are provided along the length direction of the coke oven according to the number of oven holes, as designated positions for vertical transportation of the coke oven shed crane; after the refractory bricks sent from the warehouse are transported to the site, they are transported to the refractory brick receiving platform; after the previous process is completed, the inspected refractory bricks are mixed into the designated position of the oven wall one by one through the receiving scaffold board; meanwhile, the refractory brick receiving platform should be continuously increased with the height of the oven wall masonry, and the number of steps should be synchronously increased upwards.

Furthermore, the step S3 of marking out a laying position of each layer of refractory bricks layer by layer based on the three-dimensional control network is as follows: making a refractory brick setting out scale rod and marking the size line of the refractory bricks on the refractory brick setting out scale rod for the oven wall; for different parts of the oven wall, the refractory brick setting out scale rod needs to be marked with a line; after the completion of the previous layer of refractory bricks on the oven wall of the coke oven, before the laying of this layer of refractory bricks, marking the position line of each refractory brick on both sides of the completed wall using the refractory brick setting out scale rod; the laying of each layer of refractory bricks must be marked using a refractory brick setting out scale rod to pre-mark the laying position of each refractory brick in the oven wall, and rechecked through the three-dimensional control network to achieve layer-by-layer marking.

Furthermore, the step S4 of arranging the refractory bricks required by laying of each layer by layer based on the refractory brick receiving platform is as follows: after marking the refractory bricks on each layer of the coke oven, the refractory bricks to be laid on this layer are first transported in a full box to the refractory brick receiving platform for unpacking inspection, then, according to the masonry drawings, the corresponding refractory bricks are horizontally transported, and the refractory bricks are fixedly arranged within the layer-by-layer marking positions of each wall; the entire layer of refractory bricks on the oven body is fully configured to achieve the layer-by-layer arrangement of refractory bricks on the oven body.

Furthermore, the step S5 of laying the refractory bricks layer by layer according to the marking and the arrangement based on the three-dimensional control network is as follows: after all the refractory bricks of each layer of the coke oven are arranged, the oven builders will build the refractory bricks of this layer as a whole, so that the entire coke oven body is built in a flat layer, reaching the level of the oven body built layer by layer; during the masonry process, the masonry precision should be dynamically controlled in real time based on the built three-dimensional control network to ensure the masonry precision and quality, and the masonry operation should simultaneously complete the masonry of the entire layer of refractory bricks.

Furthermore, the step S6 of jointing the laid refractory bricks layer by layer is as follows: after each layer of refractory bricks in the coke oven is laid and before the slurry is solidified, the oven builder checks and adjusts the wall of the refractory bricks in that layer; after passing the inspection, the joints of all refractory bricks in that layer should be compacted and jointed; jointing slurry should be pressed into the joints of the refractory bricks using a jointing roller, and smeared evenly and densely until the oven body is jointed layer by layer.

Furthermore, the step S7 of cleaning the jointed refractory bricks layer by layer is as follows: after all the refractory bricks in each layer of the coke oven are laid and jointed, the oven builder should clean the walls and bodies of the refractory bricks in that layer to ensure that the entire coke oven is clean, tidy, and unobstructed, achieving the goal of layer-by-layer cleaning of the oven body;

Furthermore, the step S8 of checking and accepting the cleaned refractory bricks layer by layer based on the three-dimensional control network is as follows: after all the refractory bricks in each layer of the coke oven are cleaned, the laid refractory bricks should be inspected according to the built three-dimensional control network, and the error should be controlled within the set range; the masonry quality of each layer is checked and controlled to ensure the overall precision and quality of the coke oven, and achieve the acceptance of the oven masonry layer by layer.

The beneficial effects of the present invention are as follows:

1. The three-dimensional control network for flat layer masonry established by using oven columns (vertical poles), horizontal poles, benchmark lines, and control cables can fundamentally and effectively control the masonry accuracy of refractory bricks in the oven, achieving high-precision control of refractory brick masonry from the whole to the local area. This is reflected in the high-precision control of the "layer-by-layer marking", "layer-by-layer masonry", and "layer-by-layer acceptance" processes in the 6S flat layer masonry, providing necessary guarantees for achieving 6S flat layer masonry and solving the problem of precision control in large coke oven flat layer masonry. This enables the oven body masonry precision to reach within #1 mm, greatly reducing the rework rate and improving the service life of the coke oven, and the three-dimensional control network has achieved three-dimensional dynamic control of the 6S flat layer masonry process of the oven body and real-time correction of the masonry process, increasing the qualification rate of the oven body refractory brick masonry to over 98%.
2. The use of a refractory brick receiving platform has fundamentally solved the problem of traditional staggered masonry techniques where refractory bricks are directly stacked on the newly built oven body, resulting in a chaotic masonry environment, poor cleanliness, and even damage to the newly built wall. Meanwhile, in conjunction with the "layer-by-layer arrangement" in the 6S flat layer masonry process, the masonry of the coke oven body can be carried out in an orderly and efficient manner, providing effective guarantees for the industrialization, process standardization, and standardization of coke oven body masonry. The cleanliness of the oven body is also greatly guaranteed, and the refractory bricks are arranged at designated positions through the refractory brick receiving platform, reducing the loss during the transportation of refractory bricks in traditional masonry processes.
3. The large coke oven 6S flat layer masonry process creatively adopts the overall flat layer masonry method, breaking the traditional staggered masonry process that controls the precision using the oven head. In the traditional oven body masonry process, there are inherent defects such as limited precision, low cleanliness, and slow efficiency of the oven walls, which can only be controlled separately. The 6S flat layer masonry process fundamentally solves the problems of large masonry errors, low efficiency, and low oven body cleanliness caused by the traditional staggered masonry method. It realizes the rapid cleaning and masonry of the overall flat layer of the coke oven body, reduces material loss, and saves construction time.
4. The application of the "6S" oven body flat layer masonry technology, with its "layer-by-layer marking, layer-by-layer arrangement, layer-by-layer masonry, layer-by-layer jointing, layer-by-layer cleaning, and layer-by-layer acceptance" process, enables the masonry quality of the coke oven body to be fully controlled in six technical quality dimensions throughout the entire process and in all directions. Moreover, it has made the masonry method of the coke oven body industrialized, streamlined, and standardized, greatly reducing the difficulty of masonry technology and reducing the dependence of coke oven masonry on high-level oven builders. The coke oven body has been built layer by layer from the bottom to the top, including the regenerator, inclined flue, carbonization chamber, combustion chamber, and oven top. This maximizes the precision, quality, working performance, and cleanliness of the oven body, effectively extending the service life of the coke oven.

The main solution of the present invention and further alternatives thereof may be combined freely to form a plurality of solutions, all of which may be adopted and claimed in the present invention; and each alternative can be arbitrarily combined with other compatible alternatives according to the present invention. Multiple combinations are clear to those skilled in the art based on the prior art and the common general knowledge after understanding the solutions of the present invention, all of which are technical solutions to be protected by the present invention and are not exhaustive here.

Figure 1:
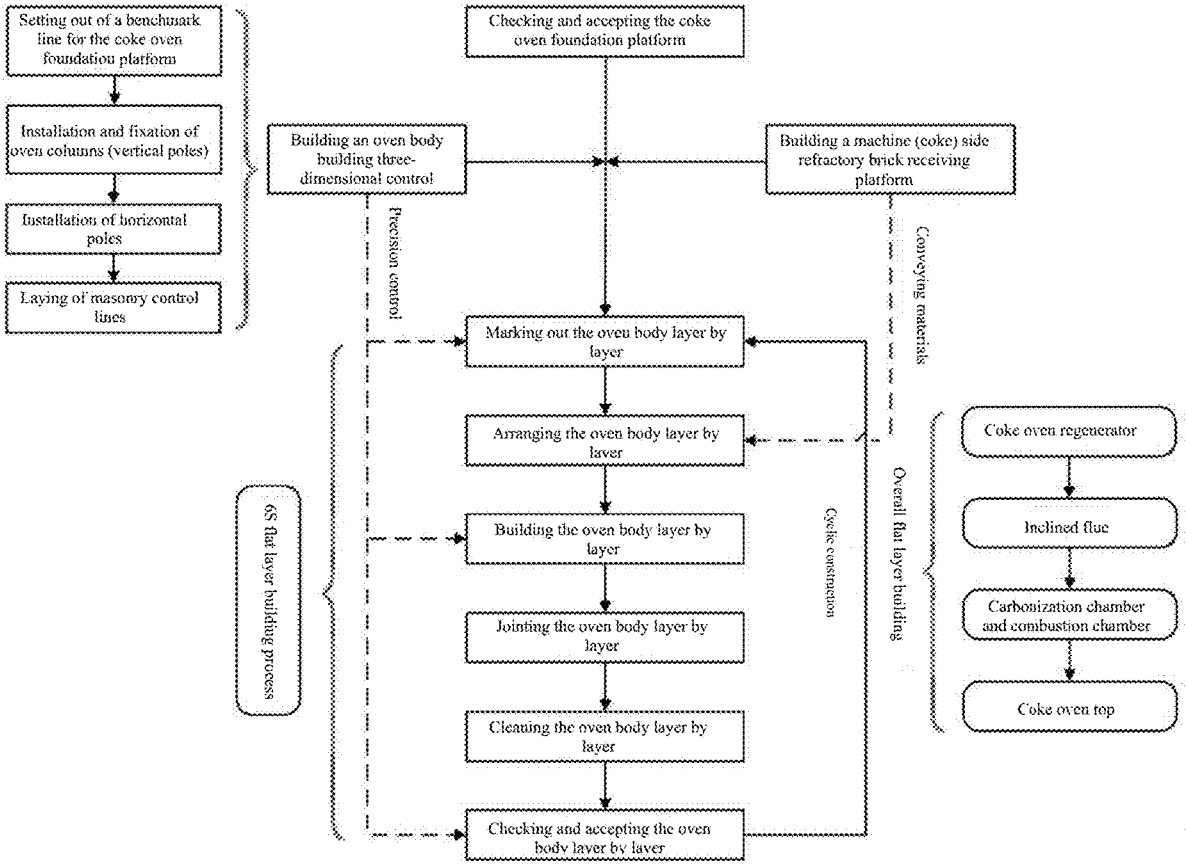
FIG. 1 is a flowchart of the present invention.

In the figures, 1—coke oven foundation platform, 2—buttress wall, 3—longitudinal coke oven center line, 4—longitudinal coke oven control sideline, 5—oven end carbonization chamber center line, 6—coke side sideline, 7—machine side sideline, 8—combustion chamber center line, 9—roof edge beam, 10—small corbel, 11—oven column, 12—adjusting pad, 13—sliding layer, 14—anchor bolt, 15—adjusting wedge, 16—lower cross brace, 17—adjustment sleeve, 18—adjusting bolt, 19—horizontal pole, 20—compression splint, 21—spring, 22—clamping bolt, 23—clamping nut, 24—snap splint, 25—wall layer height line, 26—wall width line, 27—wall center line, 28—masonry control line, 29—oven wall, 30—horizontal fixing pole, 31—coke oven body, 32—refractory brick receiving platform, 33—fixed feeding point, 34—receiving scaffold board, 35—post, 36—horizontal pole, 37—diagonal tie.

DETAILED DESCRIPTION OF THE PREFERRED EMBODIMENTS

The present invention will be described through the following non-restrictive examples.

Embodiment 1

As shown in FIGS. 1-10, a large coke oven body 6S flat layer building method comprises the following steps:

- step S1, checking and accepting the coke oven foundation platform;
- step S2, building an oven body building three-dimensional control network, and building a coke side or machine side refractory brick receiving platform;
- step S3, based on the three-dimensional control network, marking out a laying position of each layer of refractory bricks layer by layer;
- step S4, based on the refractory brick receiving platform, arranging the refractory bricks required by laying of each layer layer by layer;
- step S5, based on the three-dimensional control network, laying the refractory bricks layer by layer according to the marking and the arrangement;
- step S6, jointing the laid refractory bricks layer by layer;
- step S7, cleaning the jointed refractory bricks layer by layer; and
- step S8, based on the three-dimensional control network, checking and accepting the cleaned refractory bricks layer by layer.

The coke oven body flat layer building process is based on a three-dimensional control network and a refractory brick receiving platform, and in strict accordance with the "6S" process-"layer-by-layer marking, layer-by-layer arrangement, layer-by-layer masonry, layer-by-layer jointing, layer-by-layer cleaning, and layer-by-layer acceptance" to ensure the masonry precision and quality of each layer, and achieve high-precision and rapid masonry.

The interval between different layers of the coke oven body should be ≥2 hours. The order of laying the coke oven body 6S flat layer is from bottom to top according to the structure of the coke oven body: regenerator, inclined flue, carbonization chamber and combustion chamber, and coke oven top.

The step S1 of checking and accepting the coke oven foundation platform is as follows: completing the construction of the coke oven foundation platform 1 and laying the sliding plates, carrying out the oven body 6S flat layer masonry after acceptance.

The step S2 of building an oven body building three-dimensional control network comprises: S2.1, setting out of a benchmark line for the coke oven foundation platform; S2.2, installation and fixation of oven columns 11 or vertical poles; S2.3, installation of horizontal poles 19; S2.4, laying of masonry control lines 28.

Figure 2:
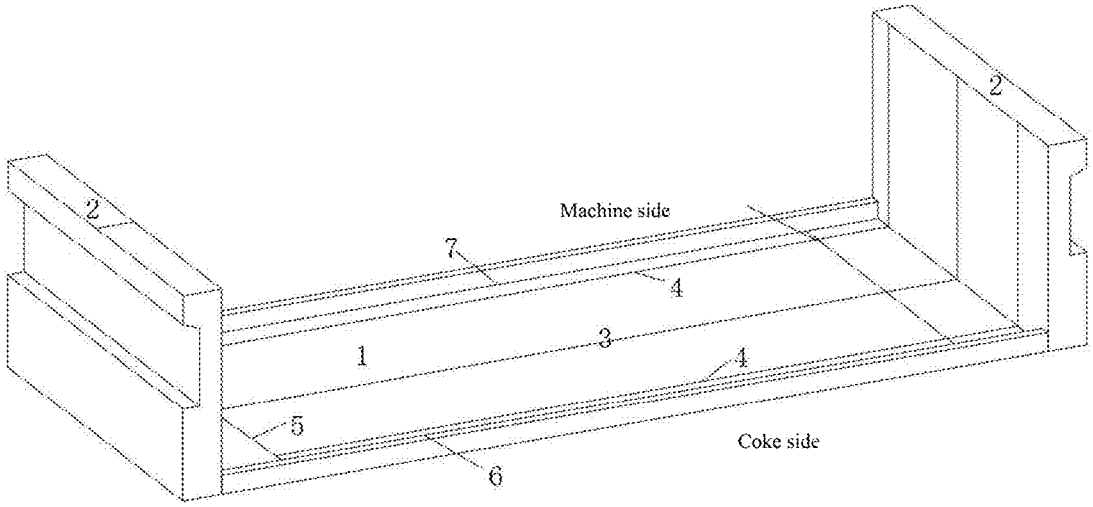
FIG. 2 is a schematic diagram of the arrangement of five benchmark lines in the horizontal and vertical directions of the present invention.

As shown in FIG. 2, the step S2.1 of setting out of a benchmark line for the coke oven foundation platform 1 comprises: setting out longitudinal coke oven center lines 3, longitudinal coke oven control sidelines 4 and oven end carbonization chamber center lines 5 on the accepted coke oven foundation platform 1 and buttress walls 2 on both ends using survey control points of the coke oven foundation platform.

Figure 3:
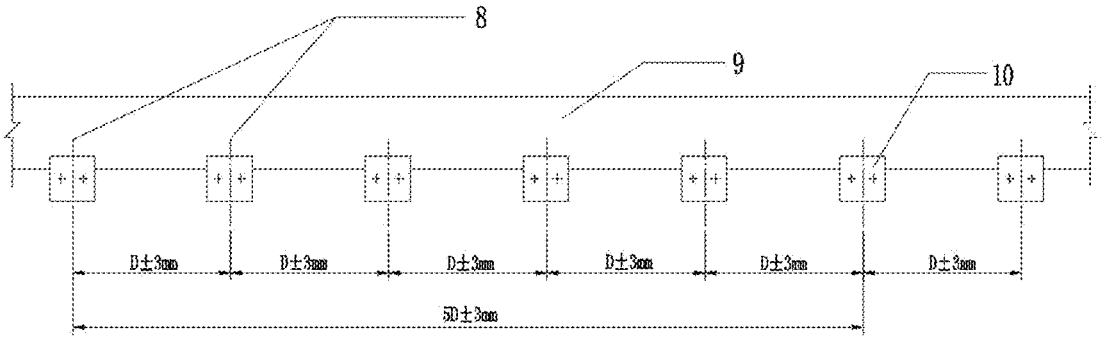
FIG. 3 is a schematic diagram of the position of the small corbel and the combustion chamber center line of the present invention.
Figure 4:
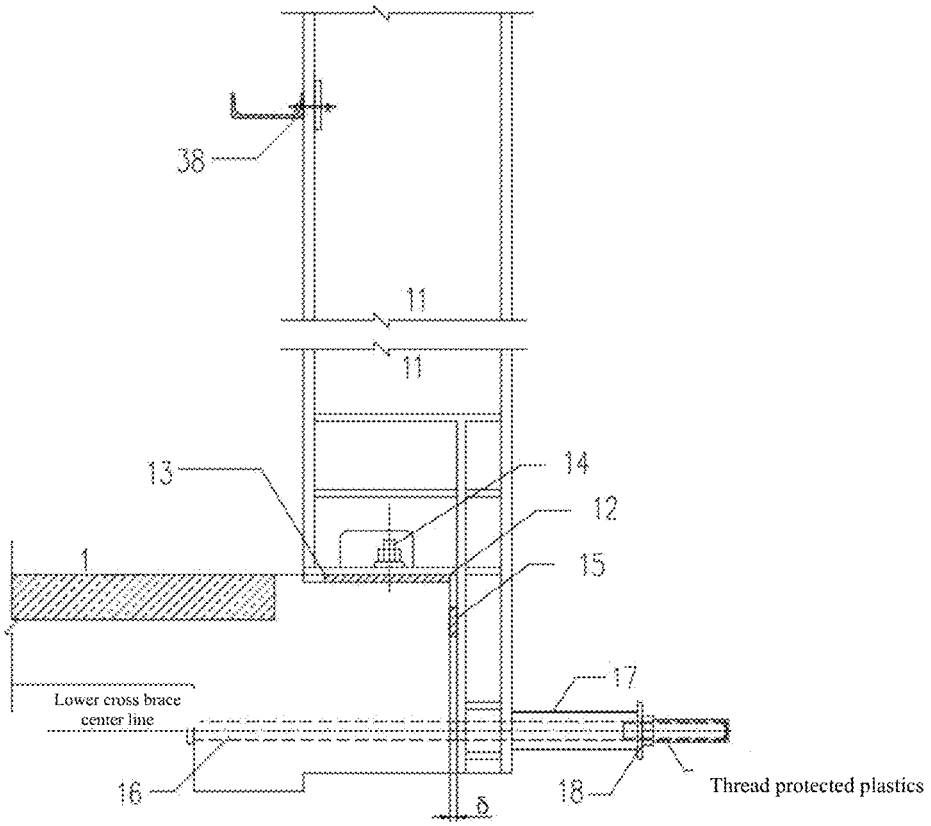
FIG. 4 is a structural diagram of the installation and fixation of oven columns of the present invention.

As shown in FIGS. 2-4, S2.2 of installation and fixation of oven columns 11 or vertical poles is as follows: the coke oven columns can be divided into two types according to the design process requirements: first erecting oven columns and then building the oven body; first building the oven body and then erecting oven columns.

When the coke oven building process is to first erect oven columns and then build the oven body, first installing oven columns 11 which will be installed on a small corbel 10 of a roof edge beam 9 of the coke oven foundation platform to build a three-dimensional control network, and measuring the elevation of the small corbel 10 before installation to ensure its elevation within a range of ±3 mm. It is possible to use a steel plate with the same thickness as the deviation value (thin backing plates are not allowed) to adjust the elevation deviation value by ±1 mm.

Placing each combustion chamber center line 8 of the coke oven onto the corresponding small corbel 10 through control points, and rechecking it based on the benchmark line set out on the coke oven foundation platform 1 to ensure the accurate position of each combustion chamber center line 8;

Hoisting the oven columns 11 by hoists and cranes and erecting the oven columns 11, then adjusting the center so that the oven column center is identical with the combustion chamber center on the small corbel 10, and the horizontal deviation value is within a range of ±3 mm.

The oven columns 11 are temporarily fixed after center adjustment; a lower cross brace (16) is pulled oppositely between the lower end of the oven column (11) and the coke oven foundation platform (1), and the lower cross brace (16) is sleeved with an adjustment sleeve (17); the lower cross brace (16) is connected with an adjusting bolt (18) that presses the adjustment sleeve (17), and the adjustment sleeve (17) temporarily compresses the oven column (11) and the coke oven foundation platform (1). During the installation stage of the coke oven spring, the adjustment sleeve on the lower cross brace is removed and replaced with the coke oven spring.

At 1-2 m from the top of the oven column 11, the entire row of oven columns 11 is connected and fixed using a horizontal fixing pole 30 (28 channel steel) through bolt connection. The two ends of the horizontal fixing pole are fixed at the buttress wall. According to the actual situation on site, 1-2 horizontal fixing poles 30 (with a vertical spacing of 1-3 m) can be added to stabilize the oven column 11.

The deviation D between oven columns should be controlled within a range of ±3 mm, and the overall deviation of every 5 consecutive oven columns should be less than ±3 mm. The sliding layer 13 in contact between the bottom of the oven column and the backing plate should be coated with yellow dry lubricant to facilitate the sliding caused by the expansion of the oven body during drying.

In order to control the verticality of the oven column and the distance between the oven column and the center of the oven, the lower cross brace is installed at the spring position by using the adjustment sleeve. The length of the adjustment sleeve is calculated based on the actual situation. slightly adjusting the elevation, verticality, and horizontal position of the oven column 11 by adjusting the adjusting pad 12 between the bottom of the oven column 11 and the coke oven foundation platform 1, as well as the adjusting wedge 15 between the side of the oven column 11 and the coke oven foundation platform 1. The gap δ between the lower part of the oven column 11 and the small corbel should be controlled within the range of 10-20 mm, and the exposed threads should be protected with plastic sleeves.

After rechecking the position and verticality of the oven column, setting out the center line 8 of each combustion chamber on the small corbel 10 on the oven column 11, and setting out the wall layer height line 25 built on the oven body on the oven column 11.

When the coke oven building process is to first build the oven body and then erect oven columns, first temporarily installing vertical poles to build a three-dimensional control network instead of oven columns, the vertical poles being made of 120×60 mm rectangular steel tubes, the height of the vertical pole being determined according to the height of the coke oven masonry; after adjusting the verticality and horizontal position of the vertical pole, setting out the center line of each combustion chamber on the small corbel on the vertical pole, and setting out the height line of the wall layer of the oven body masonry on the vertical pole. The lower part of the vertical pole is fixed to the small corbel 10 with anchor bolts 14 or embedded parts, and the upper part is provided with horizontal fixing poles 30 which are made of 100×50 mm aluminum alloy rectangular tubes.

Figure 5:
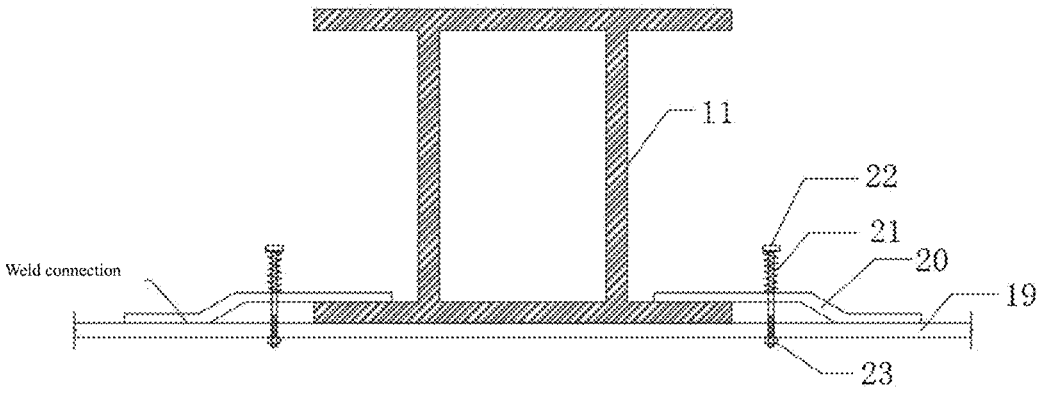
FIG. 5 is a structural top view of the horizontal pole of one oven column fixture of the present invention.
Figure 6:
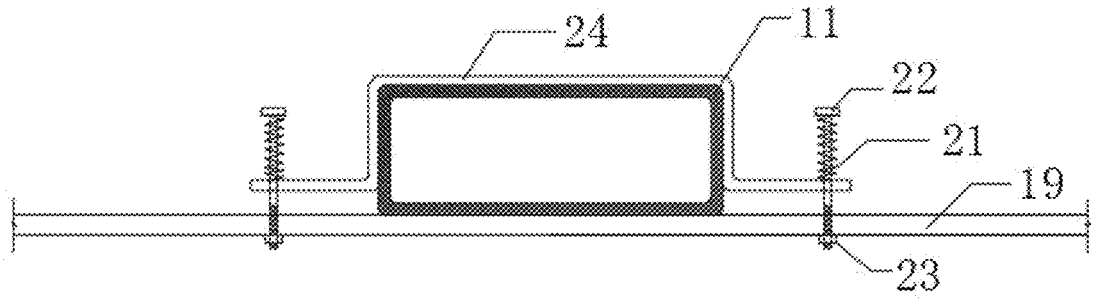
FIG. 6 is a structural top view of the horizontal pole of another oven column fixture of the present invention.

As shown in FIGS. 5 and 6, the step S2.3 of installing horizontal poles 19 is as follows: making horizontal poles 19 with 3000×100×25 mm aluminum alloy rectangular tubes, horizontally arranging the horizontal poles 19 between two oven columns 11 at sides (coke side or machine side) of the coke oven, and temporarily fixing the horizontal poles 19 and oven columns 11 by temporary stationary fixtures; after relaxing the temporary stationary fixtures, the horizontal poles can move vertically along the oven columns 11, and the horizontal poles 19 and the oven columns 11 are fixed temporarily after the temporary stationary fixtures are tightened.

When laying each layer of refractory bricks, adjusting the horizontal poles 19 to align at the wall layer height line 25 on this layer of oven columns 11, and setting out a wall center line 27 and a wall width line 26 of the wall body to be built on the horizontal poles 19, in order to provide precision control for laying of this layer of refractory bricks. The horizontal poles 19 move upwards layer by layer with the number of masonry layers.

The temporary fixing fixture includes two structural forms, one consisting of a compression splint 20 that presses the oven column 11 from both sides, and the other consisting of a snap splint 24 that is integrally pressed onto the oven column 11.

As shown in FIG. 5, the compression splint 20 is a bent plate structure. One end of the compression splint 20 is welded to the horizontal pole 19, the other end of the compression splint 20 is pressed onto the oven column 11, and the other end of the compression splint 20 and the horizontal pole 19 are jointly threaded with a clamping bolt 22. A spring 21 is provided between the screw head of the clamping bolt 22 and the compression splint 20, and a clamping nut 23 is provided on the screw of the clamping bolt 22. The elasticity of the spring 21 can be adjusted by loosening or tightening the clamping nut 23. The elasticity of the spring 21 acts on the compression splint 20, and the compression splints 20 on both sides press the oven column 11, compressing or loosening the oven column 11 and the horizontal pole 19.

As shown in FIG. 6, the snap splint 24 is a plate like structure with a U-shaped groove. The oven column 11 is just buckled in the U-shaped groove, and both ends of the snap splint 24 and the horizontal pole 19 are jointly threaded with a clamping bolt 22. A spring 21 is provided between the screw head of the clamping bolt 22 and the compression splint 20, and a clamping nut 23 is provided on the screw of the clamping bolt 22. The elasticity of the spring 21 can be adjusted by loosening or tightening the clamping nut 23. The elasticity of the spring 21 acts on the snap splint 24, and the entire snap splint 24 press the oven column 11, compressing or loosening the oven column 11 and the horizontal pole 19.

The fixture splint is made of 5 mm steel sheet. At the same time, the fixture with a spring cannot only effectively fix the horizontal pole, but also can control the splint force through the size of spring deformation, avoiding the horizontal pole deformation caused by excessive fixing force and inconsistent fixing force at both ends of the splint, which affects the precision of the three-dimensional control network. Based on this, the use of spring splint effectively improves the control precision of the three-dimensional control network. Temporary fixing fixtures should be provided at least once every one oven column, and ensure no less than two fixed points between each horizontal pole and oven column.

Figure 7:
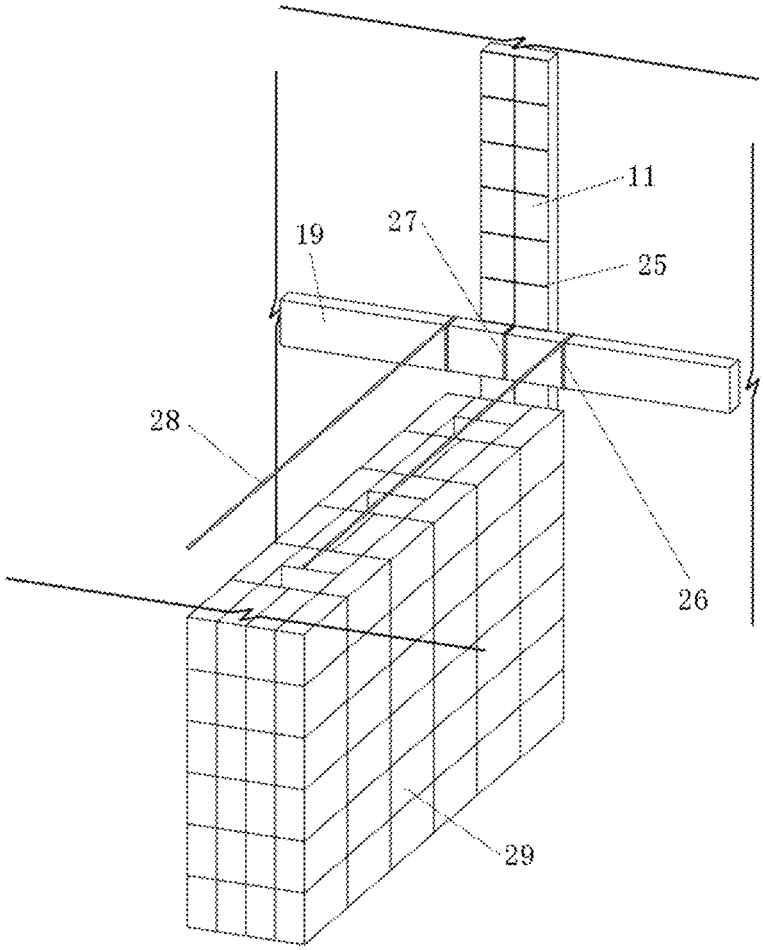
FIG. 7 is a schematic diagram of the arrangement of the oven column, horizontal pole, and masonry control line of the present invention.

As shown in FIG. 7, the step S2.4 of laying of masonry control lines 28 is as follows: drawing the wall center markings and wall width markings of the regenerator wall, inclined flue wall, carbonization chamber and combustion chamber wall or oven top wall in the oven body on the horizontal poles 19, and laying the wall center line 27 and wall width line 26 according to the markings during the masonry process, in order to dynamically control the masonry precision in real time.

Figure 8:
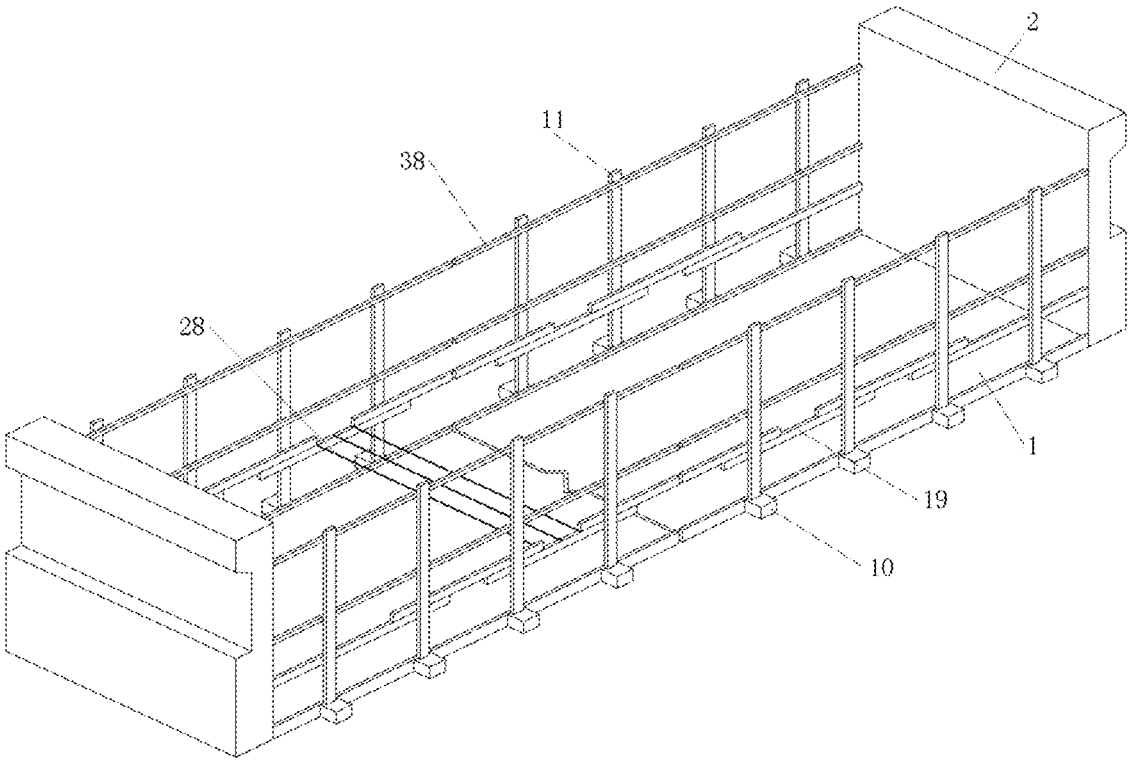
FIG. 8 is a structural schematic diagram of a three-dimensional control network for the masonry of the oven body of the present invention.

As shown in FIG. 8, the oven body building three-dimensional control network is built through S2.1-S2.4:

forming height control lines for each wall and each layer of refractory bricks of the entire oven body by a wall layer height line 25 on the oven column 11, a wall center line 27 and a wall width line 26 on the horizontal pole 19; controlling each wall length in the oven by a longitudinal coke oven center line 3 and longitudinal coke oven control sideline 4 on both sides, forming a control line for the entire wall length (width of the oven body).

The wall layer height line 25 on the oven column 11, wall center line 27 and wall width line 26 on the horizontal pole 19, longitudinal coke oven center line 3 and the longitudinal coke oven control sideline 4 can effectively perform three-dimensional control on the length, width and the height of the wall masonry in each part of the coke oven body. Meanwhile, as the three-dimensional control network is established according to the entire coke oven body, the spatial position relationship between various walls under the three-dimensional control network has also been controlled effectively and fundamentally, and the masonry process can be controlled dynamically in real time.

The coke oven body flat layer building three-dimensional control network should control the precision of its own markings within ±0.5 mm to ensure the quality of the formal masonry of the oven body. The three-dimensional control network is an independent system, and its oven column 11 and horizontal pole 19 must be firmly fixed to ensure effective precision control.

The step S2 of building a coke side or machine side refractory brick receiving platform comprises: to realize fixed point layer-by-layer arrangement of refractory bricks, a refractory brick receiving platform 32 is built at the machine side or coke side according to the receiving situation of the coke oven masonry refractory bricks, in order to meet construction requirements.

Figure 9:
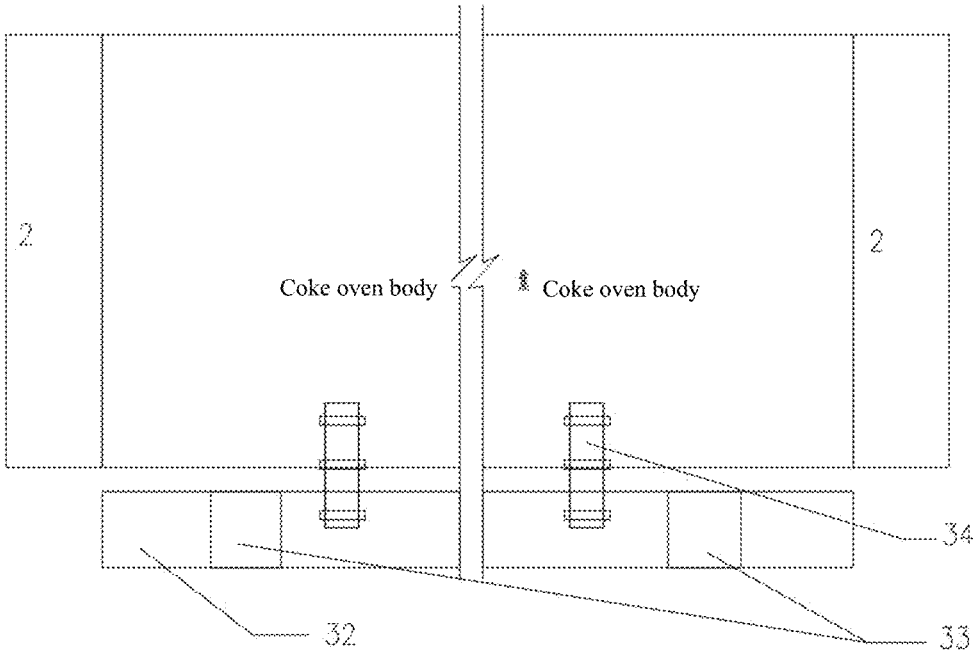
FIG. 9 is a schematic diagram of the arrangement of the refractory brick receiving platform of the present invention.
Figure 10:
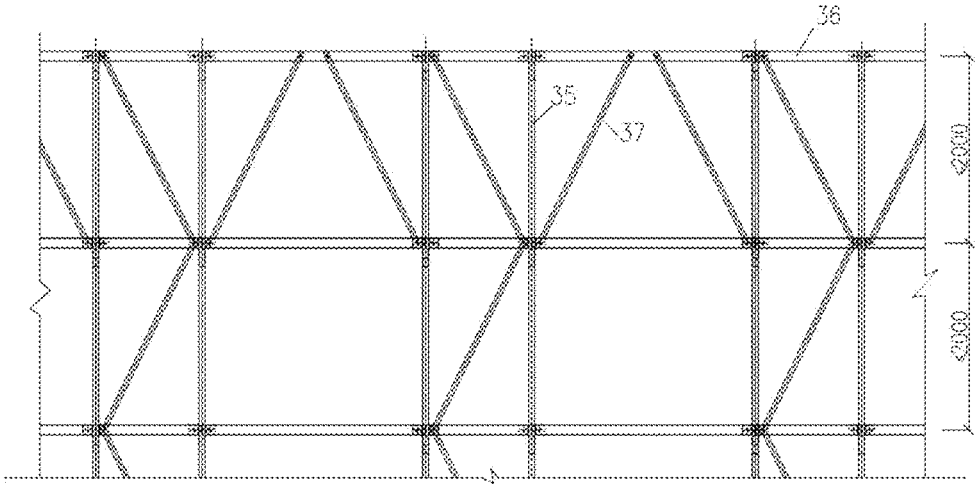
FIG. 10 is the main view of the structure of the refractory brick receiving platform of the assembled steel structure of the present invention.

As shown in FIGS. 9 and 10, a receiving platform is erected using a reusable and convenient assembled steel structure, which is connected by columns 35, horizontal poles 36, and diagonal ties 37. The platform design load should be ≥1.5 t/m$^2$. The width of the platform structure should be ≥3 m, with a scaffold board laid on top. The step distance per step in the height direction is ≤2 m, and fixed feeding points 33 are provided along the length direction of the coke oven according to 20-30 oven holes, as designated positions for vertical transportation of the coke oven shed crane.

After the refractory bricks sent from the warehouse are transported to the site, they are transported to the refractory brick receiving platform 32 by cranes; after the previous process is completed, the inspected refractory bricks are mixed into the designated position of the oven wall one by one through the receiving scaffold board 34. meanwhile, the refractory brick receiving platform 32 should be continuously increased with the height of the oven wall masonry, and the number of steps should be synchronously increased upwards.

The machine side or coke side refractory brick receiving platform 32 can also be erected using a steel pipe scaffold platform with a step distance of ≤1.8 m, a platform structure width of ≥3 m, and meeting the load requirements.

The step S3 of marking out a laying position of each layer of refractory bricks layer by layer based on the three-dimensional control network is as follows: making a refractory brick setting out scale rod using 50×50 mm battens with the length of ½ of oven wall length (width of the coke oven body) and marking the size line (including the mortar joint size) of the refractory bricks on the refractory brick setting out scale rod for the oven wall; for different parts of the oven wall, the refractory brick setting out scale rod needs to be marked with a line.

After the completion of the previous layer of refractory bricks on the oven wall inside the coke oven, before the laying of this layer of refractory bricks, marking the position line of each refractory brick on both sides of the completed wall using the refractory brick setting out scale rod. the laying of each layer of refractory bricks must be marked using a refractory brick setting out scale rod to pre-mark the laying position of each refractory brick in the oven wall, and rechecked through the three-dimensional control network to achieve layer-by-layer marking.

The step S4 of arranging the refractory bricks required by laying of each layer layer by layer based on the refractory brick receiving platform is as follows: after marking the refractory bricks on each layer of the coke oven, the refractory bricks to be laid on this layer are first transported in a full box to the refractory brick receiving platform 32 for unpacking inspection on the receiving platform, then, according to the masonry drawings, the corresponding refractory bricks are horizontally transported, and the refractory bricks are fixedly arranged within the layer-by-layer marking positions of each wall; the entire layer of refractory bricks on the oven body is fully configured to achieve the layer-by-layer arrangement of refractory bricks on the oven body.

The step S5 of laying the refractory bricks layer by layer according to the marking and the arrangement based on the three-dimensional control network is as follows: after all the refractory bricks of each layer of the coke oven are arranged, the oven builders will build the refractory bricks of this layer as a whole, so that the entire coke oven body is built in a flat layer, reaching the level of the oven body built layer by layer. During the masonry process, the masonry precision should be dynamically controlled in real time based on the built three-dimensional control network to ensure the masonry precision and quality. During masonry, the full degree of slurry in the brick joint should be ≥95%, and the masonry operation should simultaneously complete the masonry of the entire layer of refractory bricks.

The step S6 of jointing the laid refractory bricks layer by layer is as follows: after each layer of refractory bricks in the coke oven is laid and before the slurry is solidified, the oven builder checks and adjusts the wall of the refractory bricks in that layer; after passing the inspection, the joints of all refractory bricks in that layer should be compacted and jointed; jointing slurry should be pressed into the joints of the refractory bricks using a jointing roller, and smeared evenly and densely until the oven body is jointed layer by layer.

The step S7 of cleaning the jointed refractory bricks layer by layer is as follows: after all the refractory bricks in each layer of the coke oven are laid and jointed, the oven builder should clean the walls and bodies of the refractory bricks in that layer to ensure that the entire coke oven is clean, tidy, and unobstructed, achieving the goal of layer-by-layer cleaning of the oven body.

The step S8 of checking and accepting the cleaned refractory bricks layer by layer based on the three-dimensional control network is as follows: after all the refractory bricks in each layer of the coke oven are cleaned, the laid refractory bricks should be inspected according to the built three-dimensional control network, and the error should be controlled within a range of ±2 mm; the masonry quality of each layer is checked and controlled to ensure the overall precision and quality of the coke oven, and achieve the acceptance of the oven masonry layer by layer.

The aforementioned basic example of the present invention and its further selection examples can be freely combined to form multiple embodiments, which can be adopted and claimed by the present invention. In the solutions of the present invention, each selection example can be arbitrarily combined with any other basic example and selection example.

All above are only preferred embodiments of the present invention, which do not limit the scope of the present invention. All alterations, equivalent replacements and improvements, without departing from the spirit and principle of the present invention, should fall into the protection scope of the present invention.

The invention claimed is:

1. A large coke oven body 6S flat layer building method, comprising the following steps:

step S1, building a coke oven foundation platform (1), wherein the coke oven foundation platform comprises foundations for a plurality of heat storage chambers, a plurality of inclined channels, a plurality of carbonization chambers, and a plurality of combustion chambers;

step S2, building three-dimensional control network on the coke oven foundation platform for constructing the oven body, and building a coke side or a machine side refractory brick receiving platform;

step S3, marking out a laying position of each layer of refractory bricks layer by layer based on specification of the three-dimensional control network;

step S4, arranging the refractory bricks required for laying of each layer on the refractory brick receiving platform;

step S5, laying the refractory bricks layer by layer on an entirety of the coke oven foundation platform;

step S6, jointing the laid refractory bricks layer by layer;

step S7, cleaning the jointed refractory bricks layer by layer;

step S8, inspecting the cleaned refractory bricks layer by layer, wherein building the three-dimensional control network comprises in step S2 comprises:

step S21, setting of a benchmark line for the coke oven foundation platform (1);

step S22, installing oven columns (11) or vertical poles;

step S23, installing of horizontal poles (19); and step S24, laying masonry control lines (28):

forming height control lines for each wall and each layer of refractory bricks of the entire oven body by setting wall layer height lines (25) on the oven column (11), and a wall center line (27) and a wall width line (26) on the horizontal pole (19);

forming a control line across the full length of each wall by setting a longitudinal coke oven center line (3) and a longitudinal coke oven control sideline (4) each of a machine side and a coke side of the oven body, and wherein step S5 comprises: building a first layer of refractory bricks as a whole in a flat layer;

building a second layer of refractory bricks as a whole on the first layer; and successively building an additional layer of refectory bricks on a preceding layer until the height of the layers reach the height of the oven body.

2. The large coke oven body 6S flat layer building method according to claim 1, wherein step S21 comprises: setting out longitudinal coke oven center lines (3), longitudinal coke oven control sidelines (4) and oven end carbonization chamber center lines (5) on the accepted coke oven foundation platform (1) and buttress walls on both ends using survey control points of the coke oven foundation platform (1).

3. The large coke oven body 6S flat layer building method according to claim 1, wherein step S22 comprises:

when the coke oven building process is to first erect oven columns and then build the oven body, first installing oven columns on a small corbel (10) of a roof edge beam (9) of the coke oven foundation platform, and measuring the elevation of the small corbel (10) before installation to ensure the elevation of the small corbel (10) is within a set range;

placing each combustion chamber center line (8) of the coke oven onto the corresponding small corbel (10) through control points, and rechecking each combustion chamber center line (8) it based on the benchmark line set out on the coke oven foundation platform (1) to ensure the accurate position of each combustion chamber center line (8);

hoisting the oven columns (11) and erecting the oven columns (11), then adjusting the oven column so that the oven column center is aligned with the combustion chamber center on the small corbel (10) within a predetermined range of horizontal deviation;

temporarily fixing the oven columns (11), and at the top position of the oven column (11), connecting and fixing the entire row of oven columns (11) by horizontal fixing poles (30);

controlling the oven column spacing deviation and overall deviation of the oven columns (11) within a predetermined range;

adjusting the elevation, verticality, and horizontal position of the oven column (11) by adjusting the adjusting pad (12) between the bottom of the oven column (11) and the coke oven foundation platform (1), and adjusting wedge (15) between the side of the oven column (11) and the coke oven foundation platform (1);

setting out the center line (8) of each combustion chamber on the small corbel (10) on the oven column (11), and setting out the wall layer height line (25) built on the oven body on the oven column (11);

when the coke oven building process is to first build the oven body and then erect oven columns, first temporarily installing vertical poles to build a three-dimensional control network, the height of the vertical pole being determined according to the height of the coke oven masonry; after adjusting the verticality and horizontal position of the vertical pole, setting out the center line of each combustion chamber on the small corbel (10) on the vertical pole, and setting out the wall layer height line of the oven body masonry on the vertical pole, the lower part of the vertical pole being fixed to the small corbel (10) by anchor bolts (14) or embedded parts; and a sliding layer (13) is in contact between the bottom of the oven column and the backing plate.

4. The large coke oven body 6S flat layer building method according to claim 3, wherein, in step S22, a lower cross brace (16) is pulled oppositely between the lower end of the oven column (11) and the coke oven foundation platform (1), and the lower cross brace (16) is sleeved with an adjustment sleeve (17); the lower cross brace (16) is connected with an adjusting bolt (18) that presses the adjustment sleeve (17), and the adjustment sleeve (17) temporarily compresses the oven column (11) and the coke oven foundation platform (1).

5. The large coke oven body 6S flat layer building method according to claim 1, wherein step S23 comprises: horizontally arranging the horizontal poles (19) between two oven columns (11) at sides of the coke oven, and temporarily fixing the horizontal poles (19) and oven columns (11) by temporary stationary fixtures; after relaxing the temporary stationary fixtures, the horizontal poles can move vertically along the oven columns (11), and the horizontal poles (19) and the oven columns (11) are fixed temporarily after the temporary stationary fixtures are tightened;

when laying each layer of refractory bricks, adjusting the horizontal poles (19) to align at the elevation line on this layer of oven columns (11), and setting out a wall center line (27) and a wall width line (26) of the wall body to be built on the horizontal poles (19).

6. The large coke oven body 6S flat layer building method according to claim 1, wherein step S24 comprises: drawing the wall center markings and wall width markings of the regenerator wall, inclined flue wall, carbonization chamber and combustion chamber wall or oven top wall in the oven body on the horizontal poles (19), and laying the wall center line (27) and wall width line (26) according to the markings during the masonry process, in order to dynamically control the masonry precision in real time.

7. The large coke oven body 6S flat layer building method according to claim 1, wherein building a coke side or machine side refractory brick receiving platform in step S2 comprises: building a refractory brick receiving platform (32) at the machine side or coke side according to the receiving situation of the coke oven masonry refractory bricks; providing fixed feeding points (33) along the length direction of the coke oven according to the number of oven holes, as designated positions for vertical transportation of the coke oven shed crane; placing refractory bricks in designated positions of the oven wall using a receiving scaffold board (34); and increasing the height of the oven wall masonry using a refractory brick receiving platform (32).

8. The large coke oven body 6S flat layer building method according to claim 1, wherein step comprises: making a refractory brick setting out scale rod and marking the size line of the refractory bricks on the refractory brick setting out scale rod for the oven wall; for different parts of the oven wall, the refractory brick setting out scale rod needs to be marked with a line; after the completion of the previous layer of refractory bricks on the oven wall inside the coke oven, before the laying of this layer of refractory bricks, marking the position line of each refractory brick on both sides of the completed wall using the refractory brick setting out scale rod; and the laying of each layer of refractory bricks must be marked using a refractory brick setting out scale rod to pre-mark the laying position of each refractory brick in the oven wall, and rechecked through the three-dimensional control network to achieve layer-by-layer marking.

9. The large coke oven body 6S flat layer building method according to claim 1, wherein step S4 comprises: after marking the refractory bricks on each layer of the coke oven, the refractory bricks to be laid on this layer are first transported in a full box to the refractory brick receiving platform (32) for unpacking inspection, then, according to the masonry drawings, the corresponding refractory bricks are horizontally transported, and the refractory bricks are fixedly arranged within the layer-by-layer marking positions of each wall; the entire layer of refractory bricks on the oven body is fully configured to achieve the layer-by-layer arrangement of refractory bricks on the oven body;

step S6 of jointing the laid refractory bricks layer by layer is as follows: after each layer of refractory bricks in the coke oven is laid and before the slurry is solidified, the oven builder checks and adjusts the wall of the refractory bricks in that layer; after passing the inspection, the joints of all refractory bricks in that layer should be compacted and jointed; jointing slurry should be pressed into the joints of the refractory bricks using a jointing roller, and smeared evenly and densely until the oven body is jointed layer by layer;

step S7 of cleaning the jointed refractory bricks layer by layer is as follows: after all the refractory bricks in each layer of the coke oven are laid and jointed, the oven builder should clean the walls and bodies of the refractory bricks in that layer to ensure that the entire coke oven is unobstructed; and step S8 comprises: after all the refractory bricks in each layer of the coke oven are cleaned, the laid refractory bricks are inspected according to the three-dimensional control network.

* * * * *